US005723268A

United States Patent [19]

Fyson

[11] Patent Number: 5,723,268

[45] Date of Patent: Mar. 3, 1998

[54] METHOD OF PHOTOGRAPHIC COLOR PROCESSING

[75] Inventor: John Richard Fyson, Hackney, United Kingdom

[73] Assignee: Eastman Kodak Company, Rochester, N.Y.

[21] Appl. No.: 818,473

[22] Filed: Mar. 13, 1997

[30] Foreign Application Priority Data

Mar. 13, 1996 [GB] United Kingdom ..... 9605245

[51] Int. Cl.[6] ..... G03C 7/42

[52] U.S. Cl. ..... 430/430; 430/393; 430/401; 430/427

[58] Field of Search ..... 430/393, 401, 430/427, 430

[56] References Cited

U.S. PATENT DOCUMENTS 3,620,725 11/1971 Kosta ..... 430/383
4,880,728 11/1989 Ishikawa et al. ..... 430/380
5,387,499 2/1995 Earle et al. ..... 430/399
5,629,139 5/1997 Twist ..... 430/393

FOREIGN PATENT DOCUMENTS

0616255A1 3/1993 European Pat. Off. .
2323310 3/1973 Germany .

*Primary Examiner*—Hoa Van Le
*Attorney, Agent, or Firm*—J. Lanny Tucker

[57] ABSTRACT

A method of processing photographic silver halide color material comprises, in order, a dye image-forming development step, a step which has the purpose of stopping further dye formation and a bleaching or bleach-fixing. The bleaching or bleach-fixing solution is made by adding additional components to all or some of the overflow of the stop bath. This decreases stain levels without increasing chemical load.

10 Claims, No Drawings

METHOD OF PHOTOGRAPHIC COLOR PROCESSING

FIELD OF THE INVENTION

This invention relates to the processing of color photographic silver halide materials, and especially to processes involving a redox amplification dye image-forming step.

BACKGROUND OF THE INVENTION

Photographic silver halide color materials are processed using a color development step, a bleaching step and a fixing step usually followed by a wash or rinse and/or a stabilizing step. Quite often the bleaching and fixing steps are combined into a single bleach-fixing step. In such a process the development continues up to the moment the developed photographic material enters the bleach-fixing solution. This can cause stain, especially in redox amplification processes.

In redox amplification (RX) processes, color materials are developed to produce a silver image (which may contain only small amounts of silver) and then treated with a redox amplifying solution (or a combined developer-amplifier) to form a dye image.

The developer-amplifier solution contains a color developing agent and an oxidizing agent that will oxidize the color developing agent in the presence of the silver image that acts only as a catalyst.

There is a need for a color process that produces less dye stain.

SUMMARY OF THE INVENTION

According to the present invention there is provided a method of processing comprising, in order:

color developing a photographic silver halide color material to form a dye image with a color developing solution, stopping dye image formation in said color material with a stop bath, and bleaching or bleach-fixing said color material with a bleaching or bleach-fixing solution, wherein said bleaching or bleach-fixing solution is prepared by adding one or more additional components to overflow from said stop bath.

The method is particularly useful if the color developing solution is of the RX-type because the use of a bleach-fixing solution immediately following color development is very likely to stain.

The present method minimizes the chance of stain by separating the development stop step from silver oxidation in the bleaching step.

There is no increase in total chemical load needed to process the material.

The method also allows the simple removal of unreacted developing agent from the immediate post development bath by use of an appropriate adsorbent. It can then be recycled and used again.

DETAILED DESCRIPTION OF THE INVENTION

The stop bath used to stop dye formation may be a conventional acid stop bath, and the overflow from this bath provides the acid for a following bleaching or bleach-fixing step. The components for the bleaching or bleach-fixing step may be added as concentrates to the collected stop bath overflow. Alternatively, the stop bath may be plumbed such that the overflow runs co-current into the bleaching or bleach-fixing tank and solids, such as powders, tablets and/or granules and/or concentrated liquid can be added directly to the bleaching or bleach-fixing tank or a recirculation and/or replenishing system.

The stop bath can have a pH in the range 2 to 8, and preferably from 3 to 7, and can contain an acid, e.g., acetic acid. Alternatively, it can be a metabisulfite bath that is particularly useful for destroying peroxide if the color developing solution is of the RX type. The concentration of metabisulfite may be in the range of from 10 to 150 g/l, and preferably of from 25 to 100 g/l (as the sodium salt). The overflow from the stop bath can then be used as the basis of the bleach-fixing solution, the stop bath providing the bisulfite stabilization and some pH buffer for the bleach-fixing solution.

In a preferred embodiment of the present invention, the image forming step (that is, color development) is a redox amplification step. Redox amplification processes have been described, for example in British Specification Nos. 1,268,126, 1,399,481, 1,403,418 and 1,560,572.

Examples of suitable redox oxidizing agents (redox oxidant) include peroxy compounds including hydrogen peroxide and compounds that provide hydrogen peroxide, e.g., addition compounds of hydrogen peroxide; cobalt (III) complexes including cobalt hexammine complexes; and periodates. Mixtures of such compounds can also be used.

The developing or redox amplification solution may contain any of the following color developing agents:

4-amino-3-methyl-N,N-diethylaniline hydrochloride, 4-amino-3-methyl-N-ethyl-N-β-(methanesulfonamido)-ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride and 4-amino-N-ethyl-N-(2-methoxy-ethyl)-m-toluidine di-p-toluene sulfonate, and especially, 4-N-ethyl-N-(β-methanesulfonamidoethyl)-o-toluidine sesquisulfate or 4-(N-ethyl-N-2-hydroxyethyl)-2-methylphenylenediamine.

The stop bath may also have fixing action and can therefore provide the fixing agent for the bleach-fixing solution, an addition only of an oxidant then being made to the stop bath overflow.

The bleaching agents for the bleaching or bleach-fixing solutions may be metal salts, e.g., ferric salts of compounds having at least one:

$$N—[(CH_2)_n—A]_p$$

moiety wherein

A is —COOH or —$PO_3H_2$ and n is 1–6 and p is 1–3 provided that the compound contains at least 2 A groups.

Examples of such compounds include:

ethylenediaminetetraacetic acid (EDTA), propylenediaminetetraacetic acid, 2-hydroxy-1,3-propylene diaminetetraacetic acid, diethylene triamine pentaacetic acid, nitrilo triacetic acid, ethylene diamine tetramethylene phosphonic acid, diethylene triamine pentamethylene phosphonic acid, cylcohexylene diamine tetraacetic acid,

[(Ethylene dioxy)diethylene dinitrilo]tetraacetic acid, ethylene dinitrilo-N,N'-bis(2-hydroxy benzyl)-N,N'-diacetic acid and methyliminodiacetic acid.

Such bleaching agents are particularly liable to cause staining. Other bleaching agents include alkali metal ferricyanides and peroxy compounds, for example, hydrogen peroxide, persulfates, or periodates.

A bleaching solution may contain from 10 to 150 g/l preferably from 15 to 100 g/l of a ferric chelate as described above (as ferric ammonium EDTA).

A fixing solution may contain an alkali metal or ammonium thiosulfate at 100 g/l (as ammonium salt) and/or thiocyanate at 1 to 400 g/l (as ammonium salt) and/or an alkali metal sulfite as fixing agent.

A bleach-fixing solution contains both a fixing agent and a bleaching agent in the same amounts.

The developing or redox amplification solution may contain preservatives. For example they may contain hydroxylamine or a carboxy- or sulfo-substituted mono- or dialkylhydroxylamine as a preservative. The purpose for this is to protect the color developing agent against aerial oxidation. In a redox amplification solution, hydroxylamine is preferably used as a salt thereof, such as hydroxylamine chloride, phosphate or, preferably, sulfate. The amount used is from 0.05 to 10 g/l, preferably from 0.1 to 5.0 g/l and, especially, from 0.4 to 2.0 g/l (as hydroxylamine sulfate (HAS)).

The solution is preferably buffered, e.g., by a phosphate such as potassium hydrogen phosphate ($K_2HPO_4$) or by another phosphate or carbonate, silicate or mixture thereof. The pH may be in the range from 10.5 to 12, preferably in the range from 11 to 11.7 and especially from 11 to 11.4.

The concentration range of the hydrogen peroxide is preferably from 0.1 to 20 ml/l and especially from 0.5 to 2 (as 30% w/w solution).

The concentration range of the color developing agent is preferably from 1 to 15 g/l and especially from 3 to 10 g/l.

The processing solutions used in the present invention may be as described in *Research Disclosure,* Item 36544, September 1994, Sections XVII to XX, published by Kenneth Mason Publications, Emsworth, Hants, United Kingdom.

The process may take on a number of configurations, examples of which can be summarized as follows:

DEV—STOP—BLEACH—FIX
DEV—STOP—BLEACH/FIX
DEV—FIX—BLEACH/FIX
DEV—AMP—STOP—BLEACH—FIX
DEV—AMP—STOP—BLEACH/FIX
DEV—AMP—FIX—BLEACH/FIX
DEV/AMP—STOP—BLEACH/FIX
DEV/AMP—STOP—BLEACH—FIX
DEV/AMP—FIX—BLEACH/FIX

A particular application of this invention is in the processing of silver chloride color photographic paper, for example paper comprising at least 85 mol % silver chloride, especially such paper having total silver levels from 5 to 700 mg/m$^2$, and for image amplification applications, levels from 10 to 120 mg/m$^2$, particularly from 15 to 60 mg/m$^2$.

Such color materials can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

The present processing solutions are preferably used in a method of processing carried out by passing the material to be processed through a tank containing the processing solution that is recirculated through the tank at a rate of from 0.1 to 10 tank volumes per minute. Such a tank is often called a low volume thin tank or LVTT for short.

The preferred recirculation rate is from 0.5 to 8, especially from 1 to 5 and particularly, from 2 to 4 tank volumes per minute.

The recirculation, with or without replenishment, is carried out continuously or intermittently. In one method of working both could be carried out continuously while processing was in progress but not at all or intermittently when the machine was idle. Replenishment may be carried out by introducing the required amount of replenisher into the recirculation stream either inside or outside the processing tank.

It is advantageous to use a tank of relatively small volume. Hence, in a preferred embodiment of the present invention, the ratio of tank volume to maximum area of material accommodatable therein (i.e., maximum path length×width of material) is less than 11 dm$^3$/m$^2$, preferably less than 11 dm$^3$/m$^2$, and particularly, less than 3 dm$^3$/m$^2$.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm, and especially, about 2 mm. The shape of the tank is not critical but it could be in the shape of a shallow tray or, preferably, U-shaped. It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leqq F/A \leqq 23$$

wherein:

F is the flow rate of the solution through the nozzle in liters/minute; and

A is the cross-sectional area of the nozzle provided in square centimeters.

Providing a nozzle in accordance with the foregoing relationship assures appropriate discharge of the processing solution against the photosensitive material. Such Low Volume Thin Tank systems are described in more detail in the following patent specifications: U.S. Pat. No. 5,294,956, U.S. Pat. No. 5,179,404, U.S. Pat. No. 5,270,762, EP-A-559,025, EP-A-559,026, EP-A-559,027, WO 92/10790, WO 92/17819, WO 93/04404, WO 92/17370, WO 91/19226, WO 91/12567, WO 92/07302, WO 93/00612, WO 92/07301, WO 92/09932 and U.S. Pat. No. 5,436,118.

The following Examples are included for a better understanding of the invention.

EXAMPLE 1

Stop Followed by Bleach-Fix

A processing line was set up in a water bath set at 35° C. The processing tanks were 500 ml glass measuring cylinders filled with the solutions outlined below. Strips of 35 mm color paper with a silver coating weight of 83 mg/m$^2$ were exposed to sensitometric wedge and processed in two processes, the first listed being a control, for the following times.

| Solution | Time (s) |
|---|---|
| Process 1 | |
| Developer | 45 |
| Bleach-fix 1 | 45 |
| Wash | 120 |
| Process 2 | |
| Develop/amplify | 45 |
| Stop | 10 |
| Bleach-fix 2 | 35 |
| Wash | 120 |

Agitation was carried out manually by lifting a strip about 50 mm and turning it through 180° then releasing it every 5 seconds.

The following solutions were used for this example:

| Developer/Amplifier | |
|---|---|
| 1-hydroxyethylidene-1,1'-diphosphonic acid | 0.5 g |
| diethylenetriaminepentaacetic acid | 0.8 g |
| dipotassium hydrogen phosphate | 40 g |
| hydroxylammonium sulfate (HAS) | 1.3 g |
| CD3 | 5.5 g |
| potassium chloride | 0.5 g |
| hydrogen peroxide (30%) | 2.7 g |
| pH adjusted to | 11.5 |
| **Bleach-fix 1** | |
| sodium metabisulfite | 30 g |
| sodium hydroxide | 5 g |
| ammonium thiosulfate | 20 g |
| 1.56M ammonium iron (III) EDTA | 20 ml |
| water to | 1 liter |
| pH adjusted to | 5.2 |
| **Stop** | |
| sodium metabisulfite | 50 g |
| water to | 1 liter |
| pH adjusted to | 4.7 |
| **Bleach-fix 2** | |
| 1.56M ammonium iron (III) EDTA | 20 ml |
| ammonium thiosulfate | 20 g |
| Stop as above (either seasoned or not) to | 1 liter |
| pH adjusted to | 5.2 |

The experiment was repeated with pseudo seasoned bleach-fixes and stop bath made by making a processing solution by taking 300 ml of the previous processing solution in the sequence and adding to 500 ml of the fresh solution of the processing solution being seasoned. This simulates a carry over of a previous solution of 300 ml for every 500 ml being replenished. This seasoning regime is carried out from second solution to the last non-wash step so that seasoning products will be carried down the whole process as would be the case in a continuous processing machine. The seasoned bleach-fixes and fixes had 1.5 g/l silver chloride added additionally.

In order to see the effect that the processes had on stain, the unexposed portions of the wedges were measured after drying using an X-Rite densitometer.

The results obtained are tabulated below:

| Seasoning Extent | Red Stain | Green Stain | Blue Stain |
|---|---|---|---|
| | Process 1 (control) | | |
| fresh | 0.11 | 0.14 | 0.11 |
| pseudo seasoned | 0.11 | 0.15 | 0.11 |
| | Process 2 (invention) | | |
| fresh | 0.11 | 0.12 | 0.09 |
| pseudo seasoned | 0.11 | 0.12 | 0.09 |

The results demonstrate that the invention gives a 'cleaner' low stain result using the same chemicals but configured with two solutions, a stop then a bleach-fix, the bleach-fix being made from the stop, by adding silver solvent and oxidant, replacing the single bleach-fix.

EXAMPLE 2

Fix Followed by Bleach-Fix

This experiment was carried out as example 1 except that the following processes and solutions were used.

| Solution | Time (s) |
|---|---|
| Process 1 | |
| Developer | 45 |
| Bleach-fix 1 | 45 |
| Wash | 120 |
| Process 2 | |
| Developer | 45 |
| Fix | 20 |
| Bleach-fix 2 | 25 |
| Wash | 120 |

-continued

| | |
|---|---|
| **Developer** | |
| 1-hydroxyethylidene-1,1'-diphosphonic acid | 0.5 g |
| diethylenetriaminepentaacetic acid | 0.8 g |
| dipotassium hydrogen phosphate | 40 g |
| hydroxylammonium sulfate (HAS) | 1.3 g |
| CD3 | 5.5 g |
| potassium chloride | 0.5 g |
| hydrogen peroxide (30%) | 2.7 g |
| pH adjusted to | 11.5 |
| **Bleach-fix 1** | |
| sodium metabisulfite | 30 g |
| sodium hydroxide | 5 g |
| ammonium thiosulfate | 20 g |
| 1.56M ammonium iron (III) EDTA | 20 ml |
| water to | 1 liter |
| pH adjusted to | 5.2 |
| **Fix** | |
| sodium metabisulfite | 50 g |
| ammonium thiosulfate | 20 g |
| water to | 1 liter |
| pH adjusted to | 4.7 |
| **Bleach-fix 2** | |
| 1.56M ammonium iron (III) EDTA | 20 ml |
| Fix as above (either seasoned or not) to | 1 liter |
| pH adjusted to | 5.2 |

The results obtained are tabulated below:

| Seasoning Extent | Red Stain | Green Stain | Blue Stain |
|---|---|---|---|
| | Process 1 (control) | | |
| fresh | 0.11 | 0.14 | 0.11 |
| pseudo seasoned | 0.11 | 0.15 | 0.11 |
| | Process 2 (invention) | | |
| fresh | 0.11 | 0.12 | 0.10 |
| pseudo seasoned | 0.11 | 0.12 | 0.09 |

The results demonstrate that the invention gives a 'cleaner' low stain result using the same chemicals but configured with two solutions, a fix then a bleach-fix, the bleach-fix being made from the fix, by adding an oxidant, replacing the single bleach-fix.

EXAMPLE 3

Fix Followed by Bleach-Fix—Processor Experiment

A minilab processing machine fitted with low volume thin tanks was used for this experiment. As a control the processor was configured to have the following process with the replenishment rates of the solutions as indicated. The stabilizer tanks were plumbed so that the overflow from one tank flowed into the previous tank—only the last tank was replenished, i.e., counter current flow.

| Solution | Time (s) | Temp (°C.) | Rep rate (ml/m$^2$) |
|---|---|---|---|
| Developer | 45 | 35 | 160.50 |
| Bleach-fix 1 | 22 | 35 | 29.42 |
| Stabilizer | 22 | 35 | — |
| Stabilizer | 22 | 35 | — |
| Stabilizer | 22 | 35 | 246.1 |

The invention was demonstrated by replumbing the machine to have the following process. The stabilizers were again plumbed to be counter-current flow. The fix overflow was plumbed into the bleach-fix replenishment line as was the additional replenishment of the additional component such that the bleach-fix was made from the overflow of the fixer and an additional part flowing at a very low replenishment rate.

| Solution | Time (s) | Temp (°C.) | Rep. rate (ml/m$^2$) |
|---|---|---|---|
| Developer | 45 | 35 | 160.50 |
| Fix | 22 | 35 | 26.75 |
| Bleach-fix 2 | 22 | 35 | 2.67* |
| Stabilizer | 22 | 35 | — |
| Stabilizer | 22 | 35 | — |
| Stabilizer | 22 | 35 | 246.1 |

*plus overflow from previous tank.

The formulae of the solutions used in the processor were as follows:

| | Initial tank | Replenisher |
|---|---|---|
| **Developer** | | |
| 1-hydroxyethylidene-1,1'-diphosphonic acid | 0.5 g | 0.5 g |
| diethylenetriaminepentaacetic acid | 0.8 g | 0.8 g |
| dipotassium hydrogen phosphate | 40 g | 40 g |
| hydroxylammonium sulfate (HAS) | 1.3 g | 3 g |
| CD3 | 5.5 g | 8 g |
| potassium chloride | 0.5 g | — |
| hydrogen peroxide (30%) | 2.7 g | 3 g |
| pH adjusted to | 11.5 | 11.7 |
| **Bleach-fix 1** | | |
| sodium metabisulfite | 30 g | 65 g |
| sodium hydroxide | 5 g | 5 g |
| ammonium thiosulfate | 20 g | 43 g |
| 1.56M ammonium iron (III) EDTA | 20 ml | 43 ml |
| water to | 1 liter | 1 liter |
| pH adjusted to | 5.2 | 4.7 |
| **Fix** | | |
| sodium metabisulfite | 30 g | 65 g |
| sodium hydroxide | 5 g | 5 g |
| ammonium thiosulfate | 20 g | 43 g |
| water to | 1 liter | 1 liter |
| **Bleach-fix 2** | | |
| sodium metabisulfite | 30 g | |
| sodium hydroxide | 5 g | |
| ammonium thiosulfate | 20 g | |
| 1.56M ammonium iron (III) EDTA | 20 ml | |
| water to | 1 liter | |
| pH adjusted to | 5.2 | |

The processor was set up and was seasoned with 25% exposed paper that had a silver coverage of 83 mg/m$^2$ in both configurations. The stains on the paper were recorded at 0, 3 and 5 developer tank turnover (TTOs)—1 tank turnover is equal to the time required to add replenisher to the tank to the same volume as the tank). One developer tank turnover in this processor was approximately equivalent to 0.6 of the second tank turnover when the process was running at a replenishment rate of 29.4 ml/m$^2$ and correcting for tank volume difference.

The stains of the process were recorded by measuring the white portions of the seasoning prints. The results are tabulated below.

| Seasoning Extent (TTOs) | Red Stain | Green Stain | Blue Stain |
|---|---|---|---|
| | Process 1 (control) | | |
| 0 | 0.10 | 0.10 | 0.10 |
| 3 | 0.10 | 0.12 | 0.09 |
| 5 | 0.10 | 0.12 | 0.09 |
| | Process 2 (invention) | | |
| 0 | 0.09 | 0.10 | 0.08 |
| 3 | 0.10 | 0.10 | 0.09 |
| 5 | 0.09 | 0.10 | 0.09 |

The results show that the stain is less in Process 2—the invention—and that the stain changes less with time, if it changes at all. Process 2 has the same overall replenishment rate for the process but gives superior low stain levels.

The invention has been described in detail with particular reference to preferred embodiments thereof, but it will be understood that variations and modifications can be effected within the spirit and scope of the invention.

I claim:

1. A method of processing comprising, in order:

color developing a photographic silver halide color material to form a dye image with a color developing solution, stopping dye image formation in said color material with a stop bath, and bleaching or bleach-fixing said color material with a bleaching or bleach-fixing solution, wherein said bleaching or bleach-fixing solution is prepared by adding one or more additional components to overflow from said stop bath.

2. The method of claim 1 wherein said stop bath contains an alkali metal metabisulfite.

3. The method of claim 2 wherein said stop bath contains a compound having fixing ability.

4. The method of claim 3 wherein said bleaching or bleach-fixing solution contains a bleaching agent that is a ferric salt of compounds having at least one:

$$N-[(CH_2)_n-A]_p$$

moiety wherein

A is —COOH or —$PO_3H_2$ and n is 1–6 and p is 1–3 provided that the compound contains at least 2 A groups.

5. The method of claim 1 wherein said color developing solution is a redox amplification solution containing a color developing agent and a redox oxidant.

6. The method of claim 5 wherein said redox oxidant is hydrogen peroxide.

7. The method of claim 5 comprising bleach-fixing said color material.

8. The method of claim 5 wherein said stop bath is a fixing bath, and said color material is bleach-fixed after use of said fixing bath.

9. The method of claim 8 wherein said stop bath has a pH in the range from 2 to 8.

10. The method of claim 9 wherein said stop bath has a pH in the range from 3 to 7.

* * * * *